US009127469B1

(12) United States Patent
England et al.

(10) Patent No.: US 9,127,469 B1
(45) Date of Patent: Sep. 8, 2015

(54) SAFETY SYSTEM FOR CONTROLLING FLUID FLOW INTO A SUCTION LINE

(71) Applicant: The United States of America as represented by the Administrator of the National Aeronautics and Space Administration, Washington, DC (US)

(72) Inventors: John Dwight England, Arab, AL (US); Anthony R. Kelley, Somerville, AL (US); Raymond J. Cronise, Huntsville, AL (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 196 days.

(21) Appl. No.: 13/796,693

(22) Filed: Mar. 12, 2013

Related U.S. Application Data

(63) Continuation-in-part of application No. 12/698,793, filed on Feb. 2, 2010, now abandoned.

(51) Int. Cl.
*E04H 4/00* (2006.01)
*E04H 4/06* (2006.01)

(52) U.S. Cl.
CPC ..... *E04H 4/06* (2013.01)

(58) Field of Classification Search
CPC ..... E04H 4/06
USPC ..... 4/504–507
See application file for complete search history.

(56) References Cited

U.S. PATENT DOCUMENTS

| | | | | |
|---|---|---|---|---|
| 4,115,878 | A | 9/1978 | Johnson et al. | |
| 4,170,047 | A * | 10/1979 | Corsette et al. | 4/293 |
| 5,734,999 | A | 4/1998 | Nicholas | |
| 5,753,112 | A * | 5/1998 | Barnes | 210/167.12 |
| 5,978,981 | A | 11/1999 | Nelson | |
| 6,170,095 | B1 | 1/2001 | Zars | |
| 6,397,408 | B1 | 6/2002 | Veloskey et al. | |
| 6,453,482 | B1 | 9/2002 | Mullings | |
| 6,615,417 | B1 | 9/2003 | Newhard | |
| 6,988,282 | B2 | 1/2006 | Barnett et al. | |
| 7,178,179 | B2 | 2/2007 | Barnes | |
| 2001/0042266 | A1 | 11/2001 | Schroader | |
| 2003/0019025 | A1 | 1/2003 | Mullings | |
| 2006/0015996 | A1 * | 1/2006 | Goettl | 4/507 |
| 2007/0266489 | A1 | 11/2007 | Martin | |
| 2009/0019633 | A1 * | 1/2009 | Snow et al. | 4/504 |
| 2009/0064403 | A1 | 3/2009 | Wolfe | |

* cited by examiner

*Primary Examiner* — Huyen Le
*Assistant Examiner* — Christine Skubinna
(74) *Attorney, Agent, or Firm* — Peter J. Van Bergen; James J. McGroary

(57) ABSTRACT

A safety system includes a sleeve fitted within a pool's suction line at the inlet thereof. An open end of the sleeve is approximately aligned with the suction line's inlet. The sleeve terminates with a plate that resides within the suction line. The plate has holes formed therethrough. A housing defining a plurality of distinct channels is fitted in the sleeve so that the distinct channels lie within the sleeve. Each of the distinct channels has a first opening on one end thereof and a second opening on another end thereof. The second openings reside in the sleeve. Each of the distinct channels is at least approximately three feet in length. The first openings are in fluid communication with the water in the pool, and are distributed around a periphery of an area of the housing that prevents coverage of all the first openings when a human interacts therewith.

5 Claims, 9 Drawing Sheets

SAFETY SYSTEM FOR CONTROLLING FLUID FLOW INTO A SUCTION LINE

This is a continuation-in-part of application Ser. No. 12/698,793, filed Feb. 2, 2010.

ORIGIN OF THE INVENTION

The invention was made by employees of the United States Government and may be manufactured and used by or for the Government for governmental purposes without the payment of any royalties.

BACKGROUND OF THE INVENTION

1. Field of the Invention

This invention relates to safety systems for use with fluid suction lines. More specifically, the invention is a safety system that couples to the inlet of a fluid suction line and controls the flow of fluid therethrough in order to prevent injuries when there is human interaction with the safety system.

2. Description of the Related Art

Any large fluid-filled tank (e.g., pool, spa, mixing tank, storage tank, etc.) typically has at least one drain formed therein. Frequently, a suction line is coupled to the drain to facilitate removal of fluid from the tank. For example, pools and spas use pumps to continuously pull water through a drain and suction line as part of the water filtration process.

A problem with pool/spa drains (or any other tank drain that would encounter human interaction) is that human hair or extremities can become entrapped in a drain or suction line. Forces at these drains can be as much as several thousands of pounds. At these levels, human hair, fingers, toes, etc. can be violently sucked into the drain/suction line such that a person cannot free themselves from the drain/suction line. In the case of long hair, knots in the hair can readily form behind the drain as the turbulent flow of water moves through the drain and into the suction line. In the case of fingers, toes, etc., the violent sucking of the extremity can cause immediate injury thereto. If the case of suction force confined to a small area (e.g., the connection point for a pool's vacuum line), a person's torso could provide a sufficient seal to the suction area thereby trapping the person thereat. Further, if such trapping occurs well under the water's surface, a person could be in danger of drowning. Still further, in extreme cases, intestinal disembowelment could occur if a person's rectal area were trapped over a drain/suction line.

SUMMARY OF THE INVENTION

Accordingly, it is an object of the present invention to provide a safety system that can control the flow of a fluid into a suction line in order to prevent human entrapment conditions.

Another object of the present invention is to provide a safety system for coupling to the inlet of a tank, pool or spa's suction line.

Other objects and advantages of the present invention will become more obvious hereinafter in the specification and drawings.

In accordance with the present invention, a safety system is provided for placement at the inlet of a pool's suction line in order to control water flowing from the pool into the suction line. The safety system includes a sleeve adapted to fit within the pool's suction line at the suction line's inlet. The sleeve is open at a first end thereof that is approximately aligned with the suction line's inlet. The sleeve terminates at a second end thereof with a plate that resides within the suction line. The plate has a plurality of holes formed therethrough. A housing defining a plurality of distinct channels therein is fitted in the sleeve so that the distinct channels lie within the sleeve. Each of the distinct channels has a first opening on one end thereof and a second opening on another end thereof. As a result, a plurality of first openings and a plurality of second openings are defined. Each of the second openings resides in the sleeve. Each of the distinct channels is at least approximately three feet in length. Each of the first openings is in fluid communication with the water in the pool. The first openings are distributed around a periphery of an area of the housing that prevents coverage of all the first openings when a human interacts therewith.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

Figure 1:
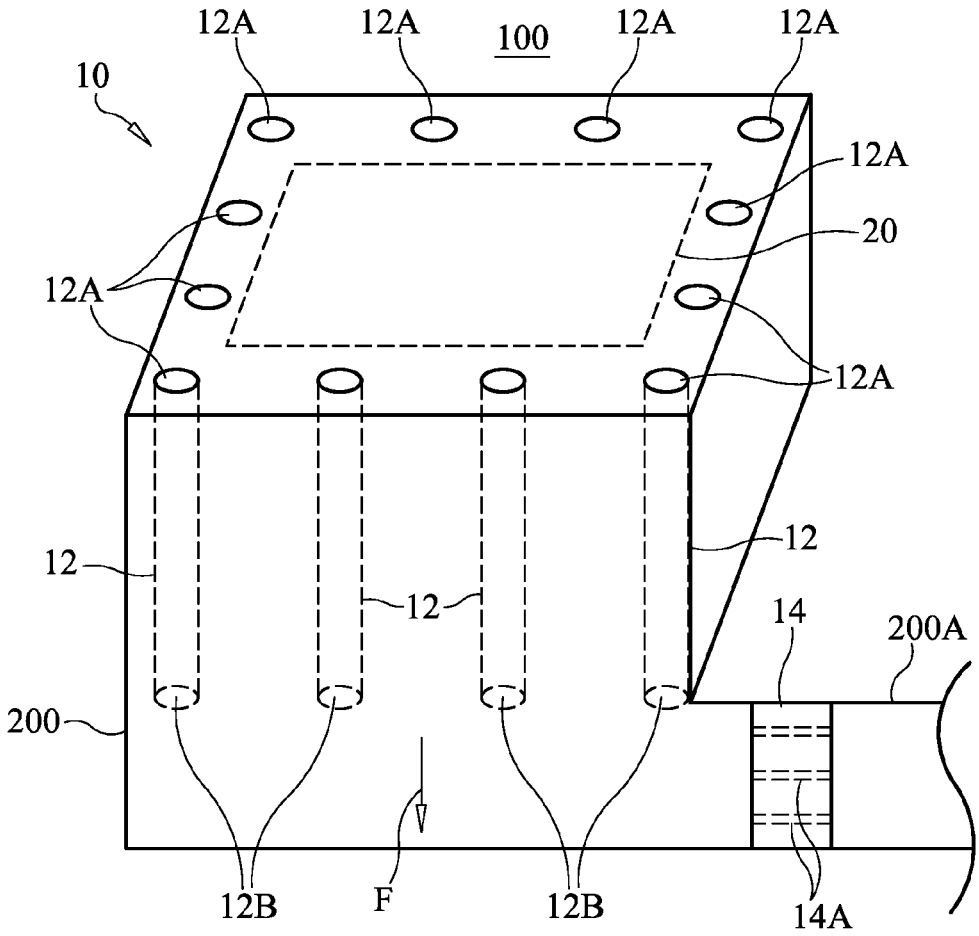
FIG. 1 is part schematic view and part cross-sectional view of a safety system used to couple a volume of liquid to a suction line in accordance with an embodiment of the present invention.

Referring now to the drawings and more particularly to FIG. 1, a safety system for controlling the flow of fluid (e.g., water) from a relatively open region 100 to the confines of a suction line 200 is shown and is referenced generally by numeral 10. Typically, a vacuum force in the direction of arrow F is applied to system 10. System 10 controls the flow of fluid (not shown) from region 100 into suction line 200 in a manner that prevents human entrapment or entanglement with system 10 even when force F is on the order of several thousand pounds. Open region 100 is representative of a tank/pool/reservoir holding a fluid that must be drawn into suction line 200. It is assumed that there is potential for human interaction with suction line 200, accidental or otherwise, thereby requiring the need for system 10. By way of illustrative example, region 100 is assumed to be a pool or spa filled with water such that suction line 200 represents a drain or skimmer line thereof used to continuously cycle water from region 100 into and through suction line 200 by means of a pump (not shown).

The basic principles embodied by the present invention will be explained using system 10. In general, system 10 defines a plurality of distinct closed conduits/channels 12 that lead from region 100 to suction line 200. Each of channels 12 has a first open end 12A in fluid communication with region 100 and a second open end 12B in communication with suction line 200. Each of closed channels 12 is long enough (e.g., typically approximately 3 feet or more in length from open end 12A to open end 12B) such that long thin objects (e.g., hair, bathing suit straps, bathing suit drawstrings, etc.) drawn into two or more separate opens ends 12A and corresponding channels 12 cannot be joined and entangled at corresponding open ends 12B in suction line 200.

Open ends 12A are distributed about/around an area defined by dashed lines 20. For clarity of illustration, only four of closed channels 12 are illustrated. Note that while area 20 is depicted to be rectangular, the present invention is not so limited as area 20 could be any regular or irregular geometric shape without departing from the scope of the present invention. Likewise, while closed channels 12 are depicted as linear, the present invention is not so limited as closed channels 12 could be non-linear, helical, or otherwise complexly curved along their lengths to thereby define longer paths in a smaller area.

The goal/function of area 20 is to define a region that positions open ends 12A in a geometrical arrangement that prohibits coverage of all or most of open ends 12A when there is some form of human interaction with system 10 from region 100. More specifically, area 20 and arrangement of open ends 12A are such that various human extremities (e.g., hair, fingers, hands, toes, feet, etc.) and larger body parts (e.g., rectal areas, torso regions to include one's stomach or back, etc.) cannot cover a substantial number or all of open ends 12A.

System 10 can also include a secondary device 14 having multiple pass-through holes 14A extending therethrough. Device 14 is typically a multiple-hole plate, pipe or plug placed between open end 12B and spanning a portion 200A of suction line 200 leading away from system 10. Plate/plug 14 eliminates limb entrapment in suction line portion 200A if system 10 becomes damaged or is missing.

A variety of constructions embodying the principles of system 10 are possible without departing from the scope of the present invention. As will be explained further below, some of the constructions are designed for a new pool/spa/tank constructions, while others are retro-fit designs readily installed in existing construction.

Figure 2:
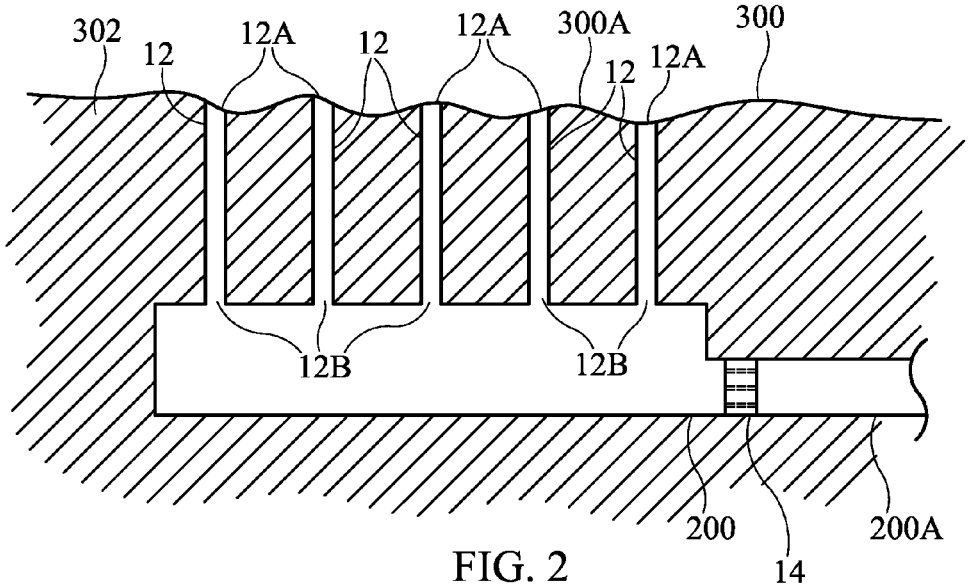
FIG. 2 is a cross-sectional view of a safety system for incorporation into a new pool construction in accordance with an embodiment of the present invention.
Figure 3:
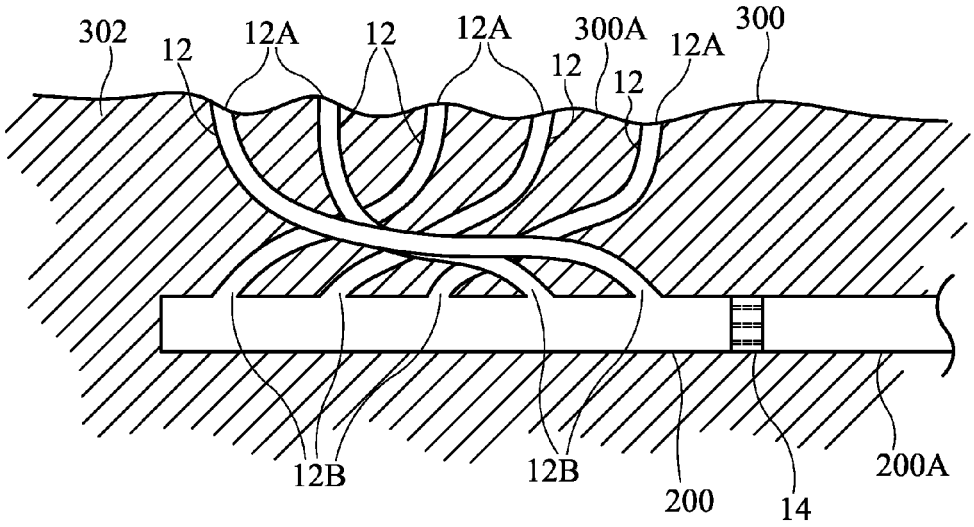
FIG. 3 is a cross-sectional view of a safety system for incorporation into a new pool construction in accordance with another embodiment of the present invention.

Referring first to FIGS. 2 and 3, two embodiments of the present invention for new pool constructions will be presented/explained. In FIG. 2, a portion of the bottom of a pool is indicated by reference numeral 300. A portion 300A of bottom 300 incorporates topographic features such as a wavy or undulating surface as illustrated. Formed in the bed 302 of pool bottom 300 are closed channels 12 with open ends 12A located in undulating surface region 300A and open end 12B located in suction line 200. Since undulating surface region 300A is a non-flat surface, there is little to no possibility that a human body part will be able to cover undulating surface region 300A and open ends 12A. Further, the length of each closed channel 12 is typically at least approximately three feet in length. In this embodiment, closed channels 12 are linear along their lengths leading to suction line 200. Plate/plug 14 can be included as described above.

In FIG. 3, closed channels 12 are similarly formed in pool bed 302 but are nonlinear along their lengths. For example, channels 12 could be helical or otherwise complexly curved along their lengths to thereby define longer path lengths in a smaller area. Similar to the previous embodiment, each closed channel 12 is typically at least approximately 3 feet long with open ends 12B positioned in suction line 200. Plate/plug 14 can be included as described above.

The present invention can also be realized in a variety of kit-type constructions designed to be retrofit to existing pool-to-suction line interfaces. Several non-limiting examples will be disclosed herein with the aid of FIGS. 4-11. In each of the embodiments, a pool's suction line is referenced by numeral 200, the pool bottom is referenced by numeral 300, and the pool water to be pulled into suction line 200 is referenced by numeral 102. In each of the ensuing retrofit designs, the basic principles detailed above will be followed.

Figure 4:
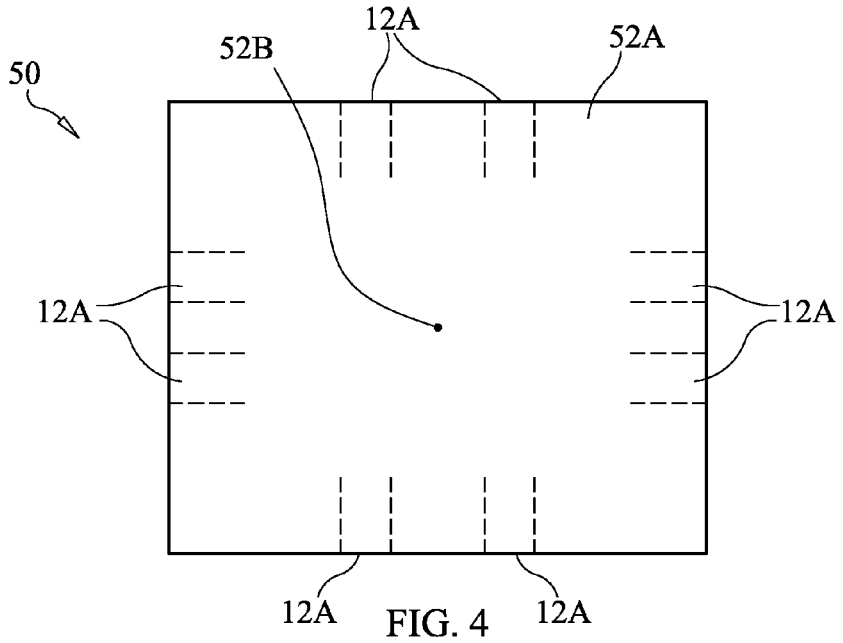
FIG. 4 is a plan view of the top of a retro-fit safety system for use with an existing pool in accordance with an embodiment of the present invention.
Figure 5:
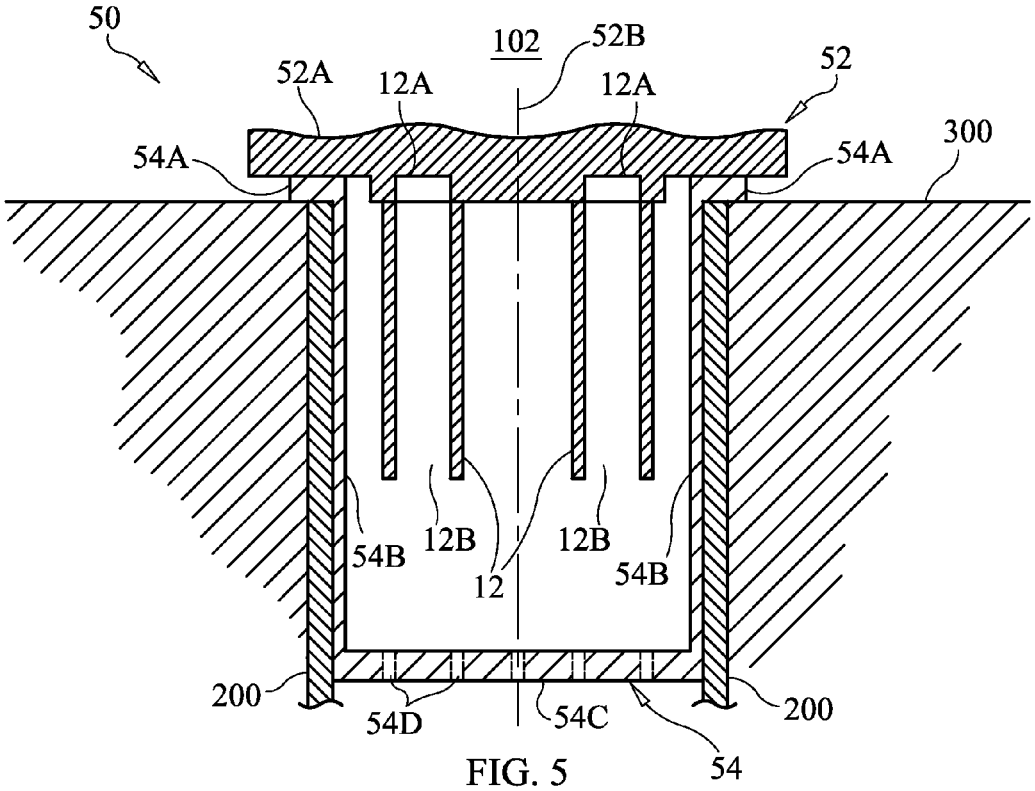
FIG. 5 is a cross-sectional view of a retro-fit safety system using the top illustrated in FIG. 4 with a top surface thereof that presents topographic features in accordance with an embodiment of the present invention.

FIGS. 4 and 5 illustrate top and cross-sectional views, respectively, of a safety system 50 having a flow housing 52 and a flow sleeve 54. A top plan view of housing 52 is shown in FIG. 4. In general, sleeve 54 fits within suction line 200 at the inlet of the suction line and housing 52 fits within sleeve 54. For ease of installation, sleeve 54 can include an annular flange 54A (e.g., integrated with sleeve 54). In this way, sleeve 54 can simply be dropped into suction line 200 so that the open end of sleeve 54 defined at flange 54A is aligned approximately with the inlet of suction line 200 as shown. Flange 54A can be cemented or otherwise adhered to the inlet of suction line 200 if desired.

Housing 52 has a top area 52A thereof exposed to pool water 102. Housing 52 is generally T-shaped and defines/supports a number of closed channels 12 (each of which is typically at least 3 feet in length) with open ends 12A exposed to pool water 102 and open ends 12B exposed to suction line 200. More specifically, open ends 12A are distributed about a periphery of housing 52. When housing 52 is installed in sleeve 54, open ends 12A are located at the pool's bottom 300 and exposed to pool water 102 with each open end 12A facing substantially radially outward with respect to the central longitudinal axis 52B of housing 52.

Top area 52A can be smooth as illustrated in FIG. 4, or can present topographic features such as an undulating surface as shown in FIG. 5 to further limit the possibility of covering all of open ends 12A. This ensures that the full suction force applied via suction line 200 can never be applied fully to a body interacting with housing 52. Top area 52A between open ends 12A can be made large enough to prevent coverage thereof by a human extremity or even larger body parts. Top area 52 can be rectangular (as shown) or any other regular or irregular shape without departing from the scope of the present invention.

The features and benefits provided by the above-described plate/plug 14 are incorporated into sleeve 54. More specifically, sleeve 54 has side walls 54B extending from annular flange 54A and into suction line 200. Side walls 54B terminate in a plate 54C having through holes 54D. The length of sleeve 54 is such that plate 54C is spaced apart from open ends 12B defined by housing 52.

To install safety system 50, sleeve 54 is simply positioned in suction line 200 and housing 52 is dropped into sleeve 54. Sleeve 54 can remain in place to provide a degree of entrapment protection when housing 52 is removed for cleaning, repair, or replacement.

Figure 6:
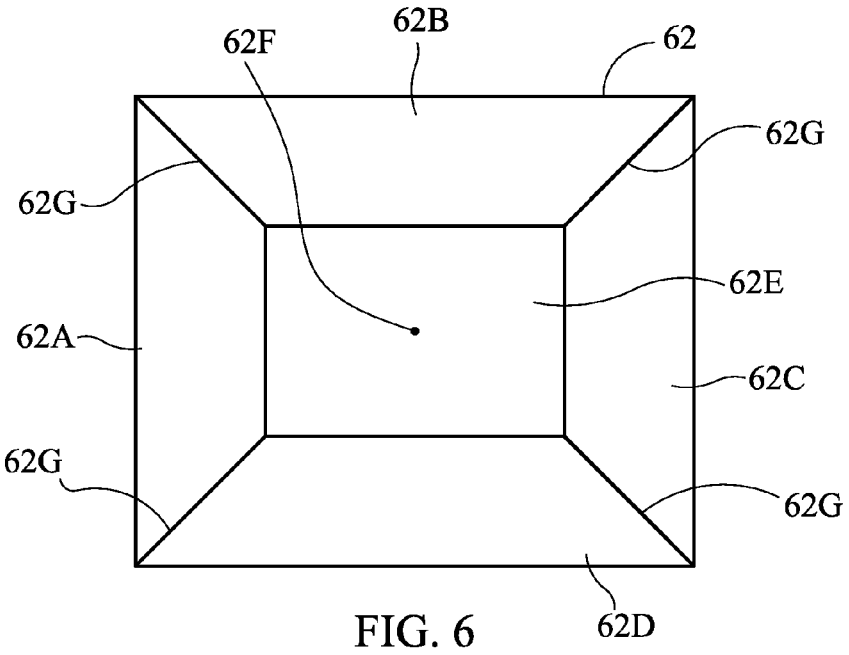
FIG. 6 is a plan view of the top of a retrofit safety system for use with an existing pool in accordance with another embodiment of the present invention.
Figure 7:
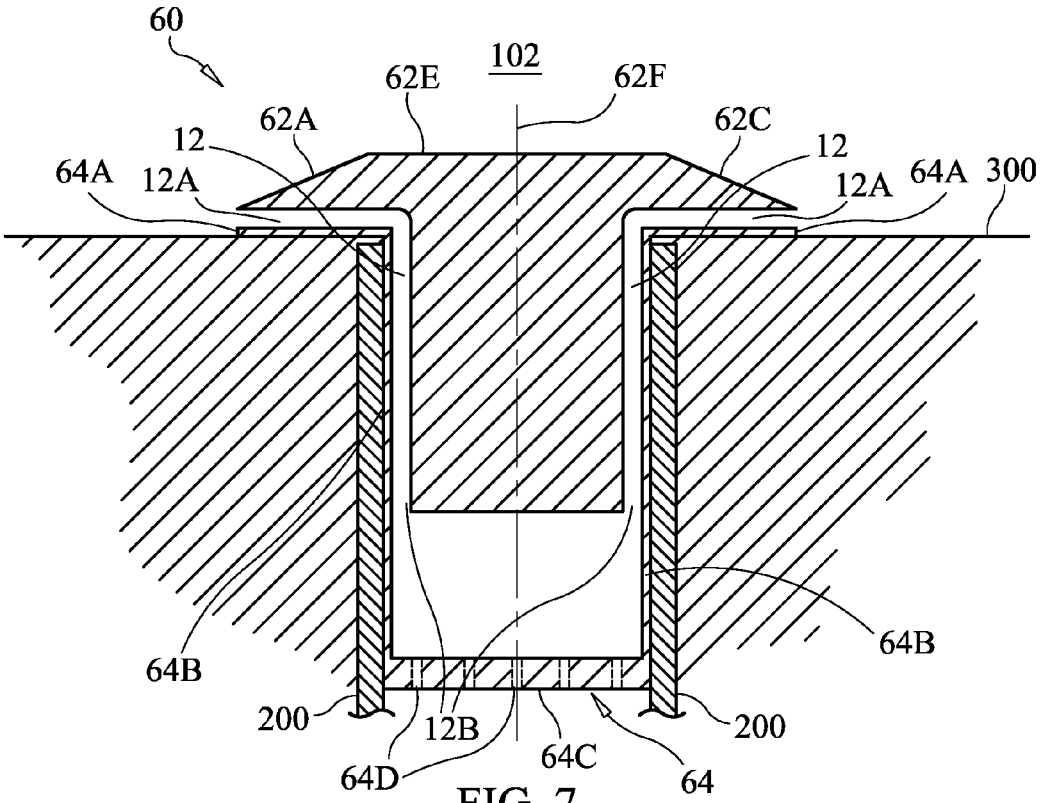
FIG. 7 is a cross-sectional view of a retro-fit safety system using the top illustrated in FIG. 6.

Another retro fit embodiment is illustrated in FIGS. 6 and 7 where a safety system 60 has a dome-like top with sloping sides 62A-62D originating at a top 64E and terminating above pool bottom 300. Top 64E could be smooth or present topographic features where it interfaces with pool water 102 without departing from the scope of the present invention. A flow sleeve 64 (i.e., analogous to sleeve 54 with elements 64A-64D corresponding to elements 54A-54D, respectively) is fitted in/sealed to suction line 200. Each side 62A-62D terminates at a peripheral region of housing 62 to define an opening 12A of a closed channel 12 that is typically at least 3 feet in length as they are led through housing 62 to corresponding open ends 12B in sleeve 64. As in the previous embodiment, open ends 12A face substantially radially outward with respect to the central longitudinal axis 62F of housing 62. The regions 62G where adjacent sloping sides meet define walls (not shown) between open ends 12A where such walls rest on annular flange 64A.

Note that while each of the embodiments illustrated in FIGS. 4-7 is rectangular, they could also be other shapes (e.g., round, triangular, octagonal, etc.) without departing from the scope of the present invention. Note also that while these embodiments depict open ends 12A above pool bottom 300, the present invention is not so limited as the various embodiments of the present invention could also be designed such that open ends 12A reside just below pool bottom 300.

Figure 8:
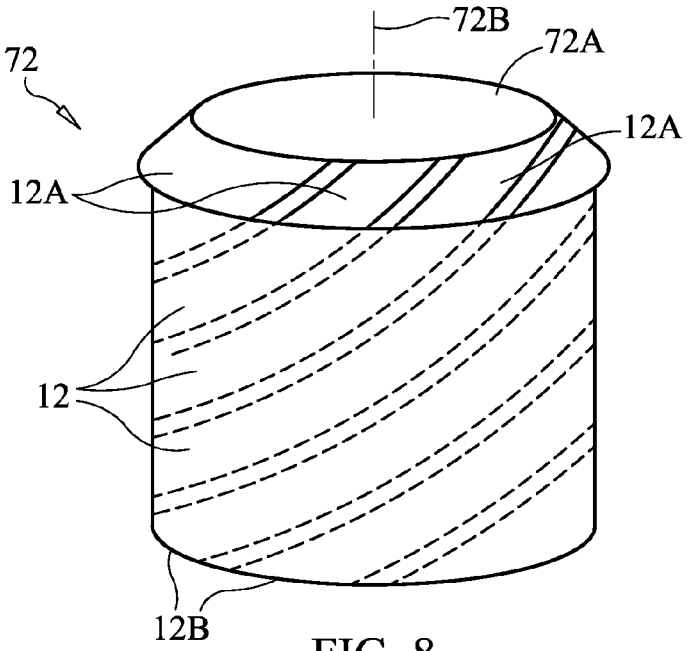
FIG. 8 is an isolated perspective view of a safety system housing for use with an existing pool in accordance with another embodiment of the present invention.
Figure 9:
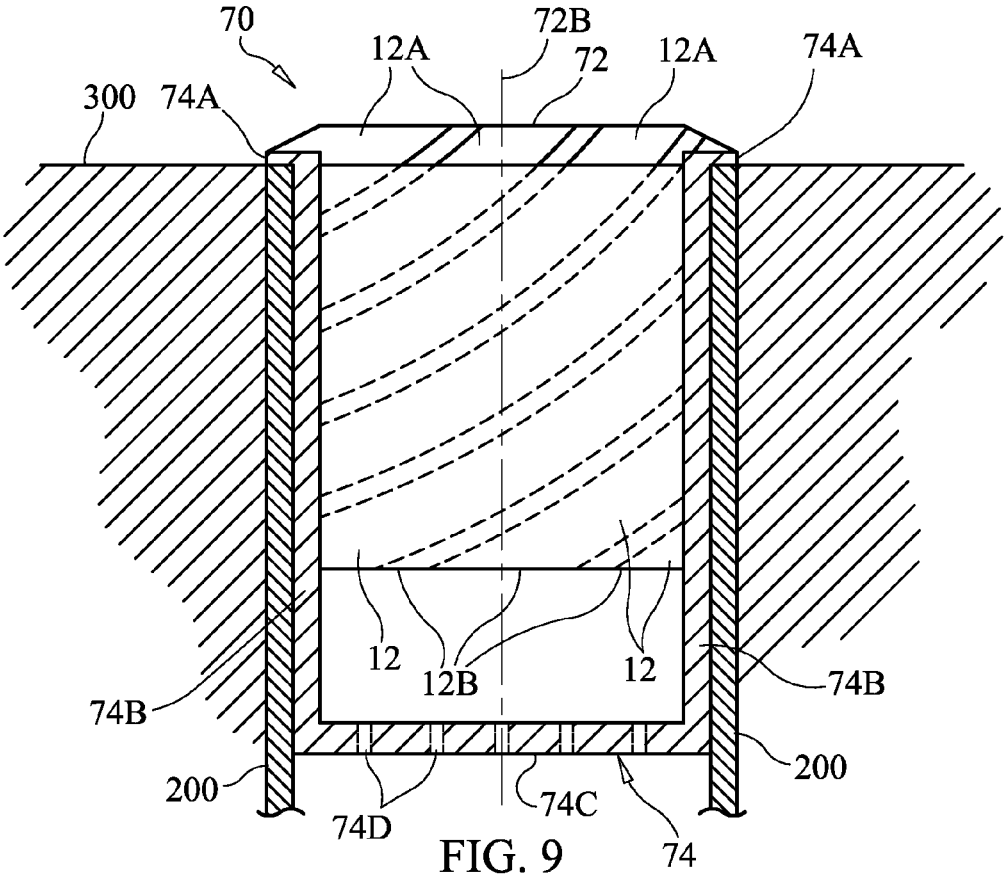
FIG. 9 is a side view of a safety system incorporating the housing illustrated in FIG. 8 with the safety system installed in the inlet of a pool's suction line.

Still another embodiment of a retrofit safety system is illustrated in FIGS. 8 and 9. The safety system's housing 72 has a solid top area 72A large enough to prevent coverage by human extremities. Top area 72A could be smooth or define topographic features. The upper periphery of housing 72 defines a number of open ends 12A of channels 12 that helically wrap about or within the radial periphery of housing 72. Once again, open ends 12A face in substantially radially outward direction from the central longitudinal axis 72B of housing 72. If channels 12 are formed on the outside of housing 72, then housing 72 is sized to form a sliding fit in sleeve 74 (FIG. 9) such that the combination of housing 72 and side walls 74B of sleeve 74 define distinct and closed channels 12. Open ends 12B at the end of channels 12 are located in sleeve 74 and spaced apart from plate 74C. Note that while channels 12 are illustrated as helical in this embodiment, they could assume some other nonlinear path without departing from the scope of the present invention. Solid top area 72A is shown to have approximately the same diameter as housing 72, but may be larger if necessary to increase the distribution area of open ends 12A depending on available space for housing 72.

Figure 10A:
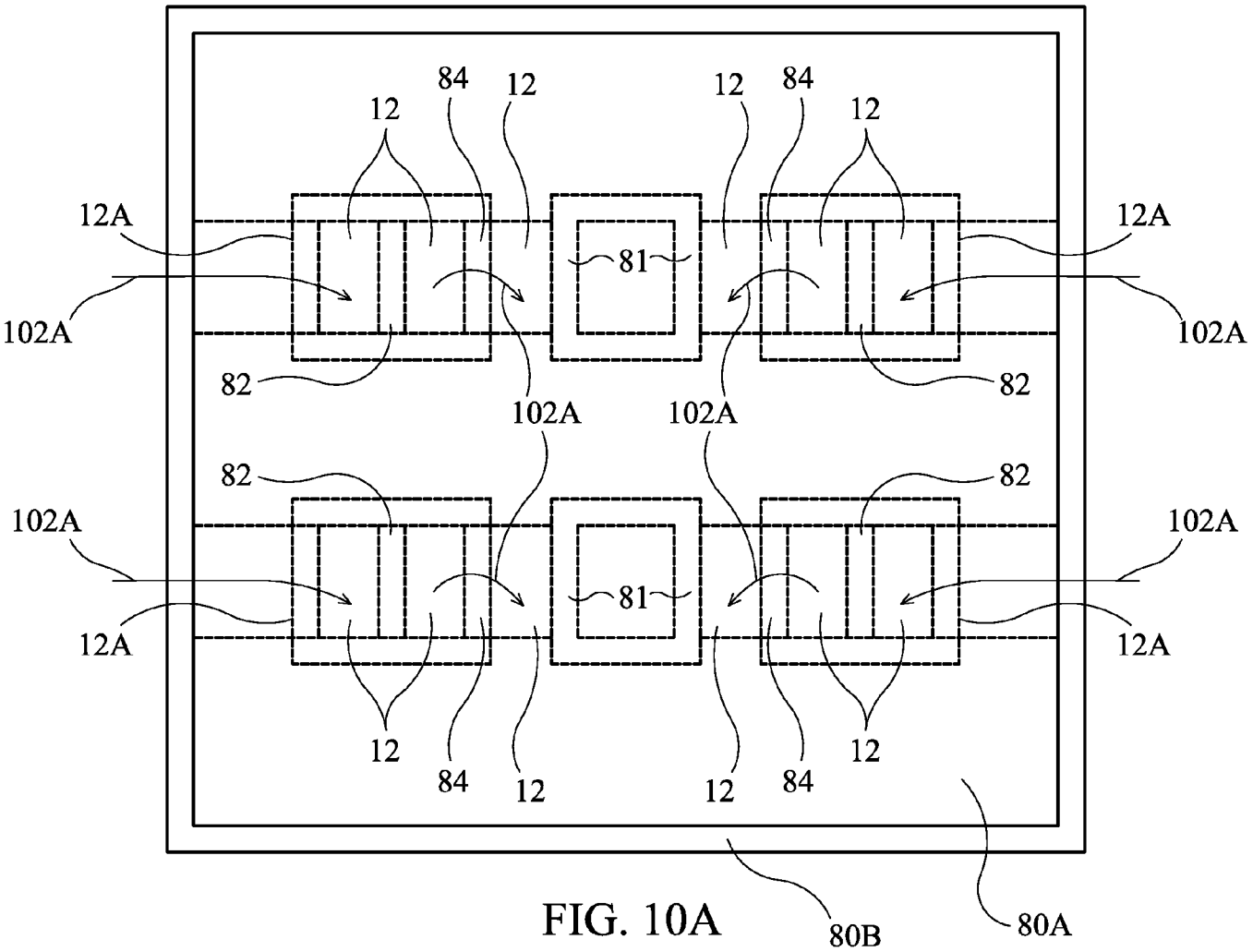
FIG. 10A is a plan view of the top of a multiple piece safety system housing in accordance with another embodiment of the present invention.
Figure 10B:
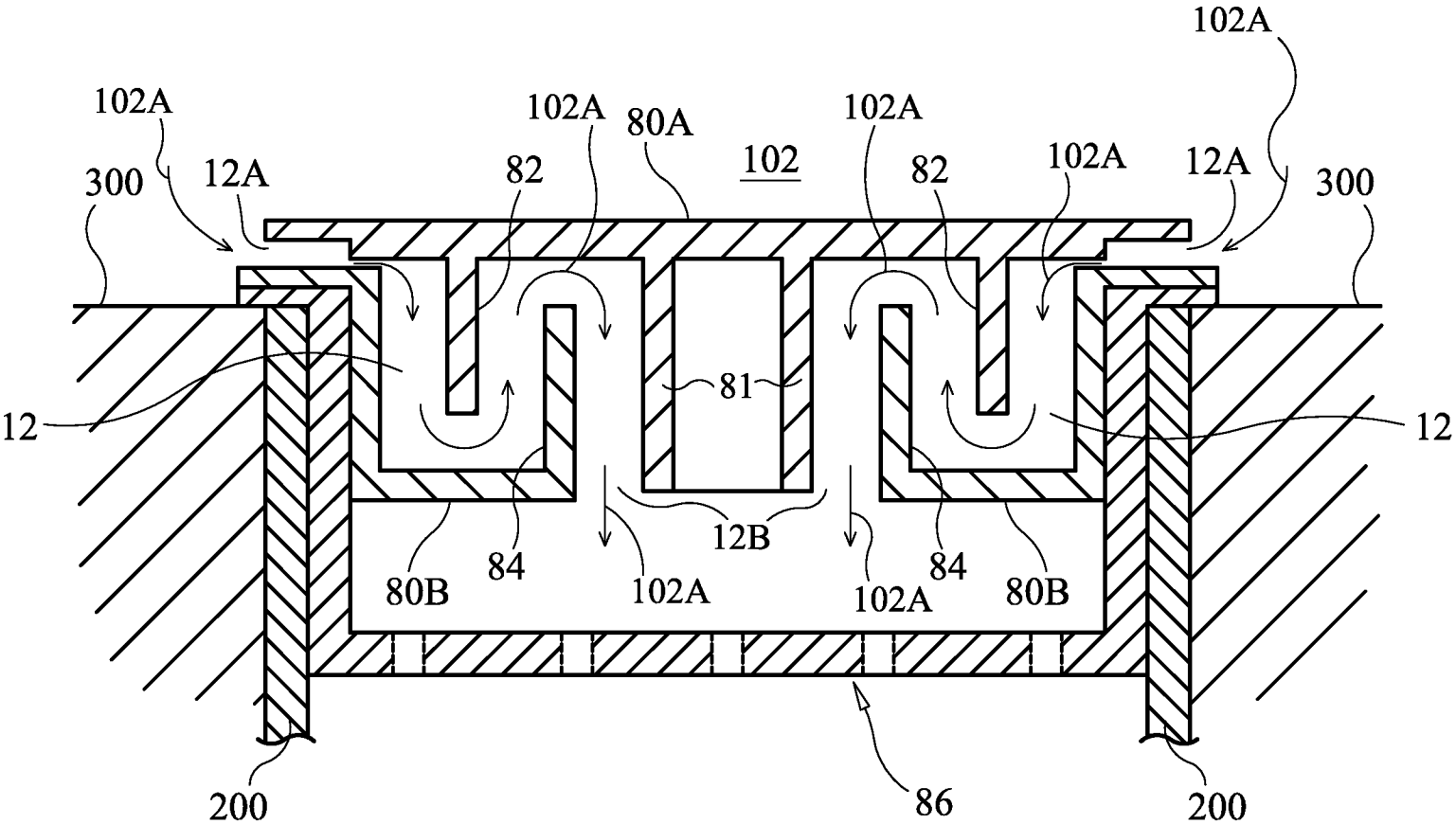
FIG. 10B is a cross-sectional view of the multiple piece safety system housing illustrated in FIG. 10A.
Figure 11:
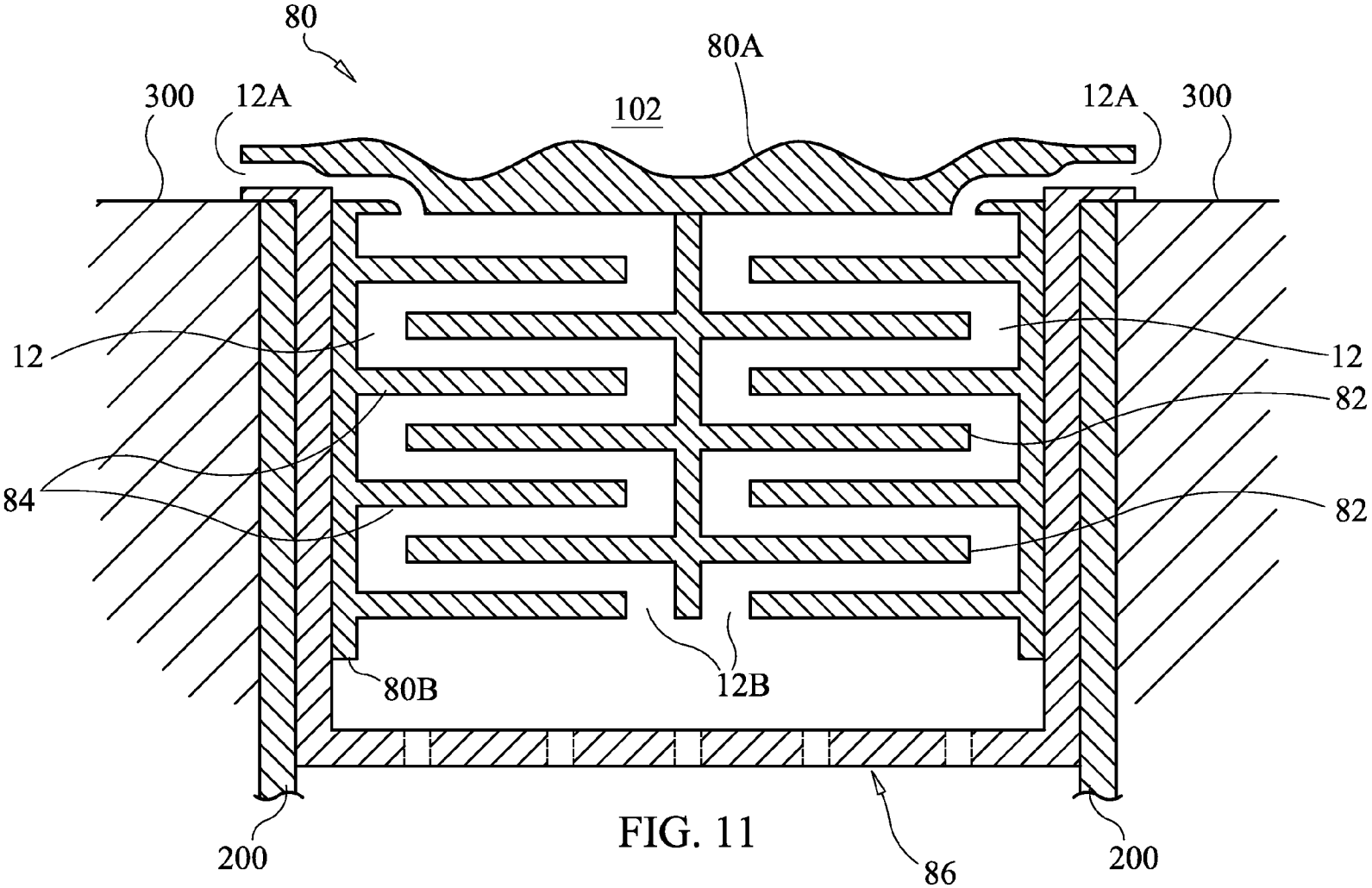
FIG. 11 is a cross-sectional view of multiple piece safety system housing in accordance with another embodiment of the present invention.

The flow housings described in the previous embodiments can be one-piece or multiple piece housings without departing from the scope of the present invention. In terms of a possible multiple piece housing, FIGS. 10A and 10B illustrate a two-piece flow housing 80 with a top half 80A including partitions 82 and a bottom half 80B including partitions 84. When halves 80A and 80B are joined, partitions 82 and 84 are interlaced to define vertically-serpentining distinct closed channels 12 along with open ends 12A and 12B. For simplicity of illustration, only four closed channels 12 are illustrated. However, more than four could be used without departing from the scope of the present invention. Each closed channel 12 admits a flow 102A of pool water 102 via its corresponding open end 12A. Each flow 102A follows a serpentine flow path that goes down one side of partition 82, underneath partition 82, between partitions 82/84, over partition 84, and down between partition 84 and a downward portion 81 of top half 80A before finally exiting the channel's open end 12B. FIG. 11 depicts a similar embodiment with horizontally-serpentining closed channels 12. Other multiple-piece designs could be used without departing from the scope of the present invention. In each of the FIGS. 10 and 11 embodiments, a flow sleeve 86 (i.e., analogous to the flow sleeves described previously herein) is positioned in suction line 200 in the same fashion as in the previously-described embodiments.

The advantages of the present invention are numerous. A simple safety system is based on principles that can be applied in new or existing pool, spa, or any other fluid tank. The safety system distributes drain/recirculation suction openings and suction force over an area that prevents substantial coverage thereof when a human interacts therewith. Further, the system controls flow therethrough in a way that prevents entanglement of hair or clothing that might be sucked into the safety system. Still further, the flow sleeve's multiple-hole plate provides added protection against limb entrapment and injury in the event the safety system's flow housing is damaged or must be temporarily removed.

Figure 12:
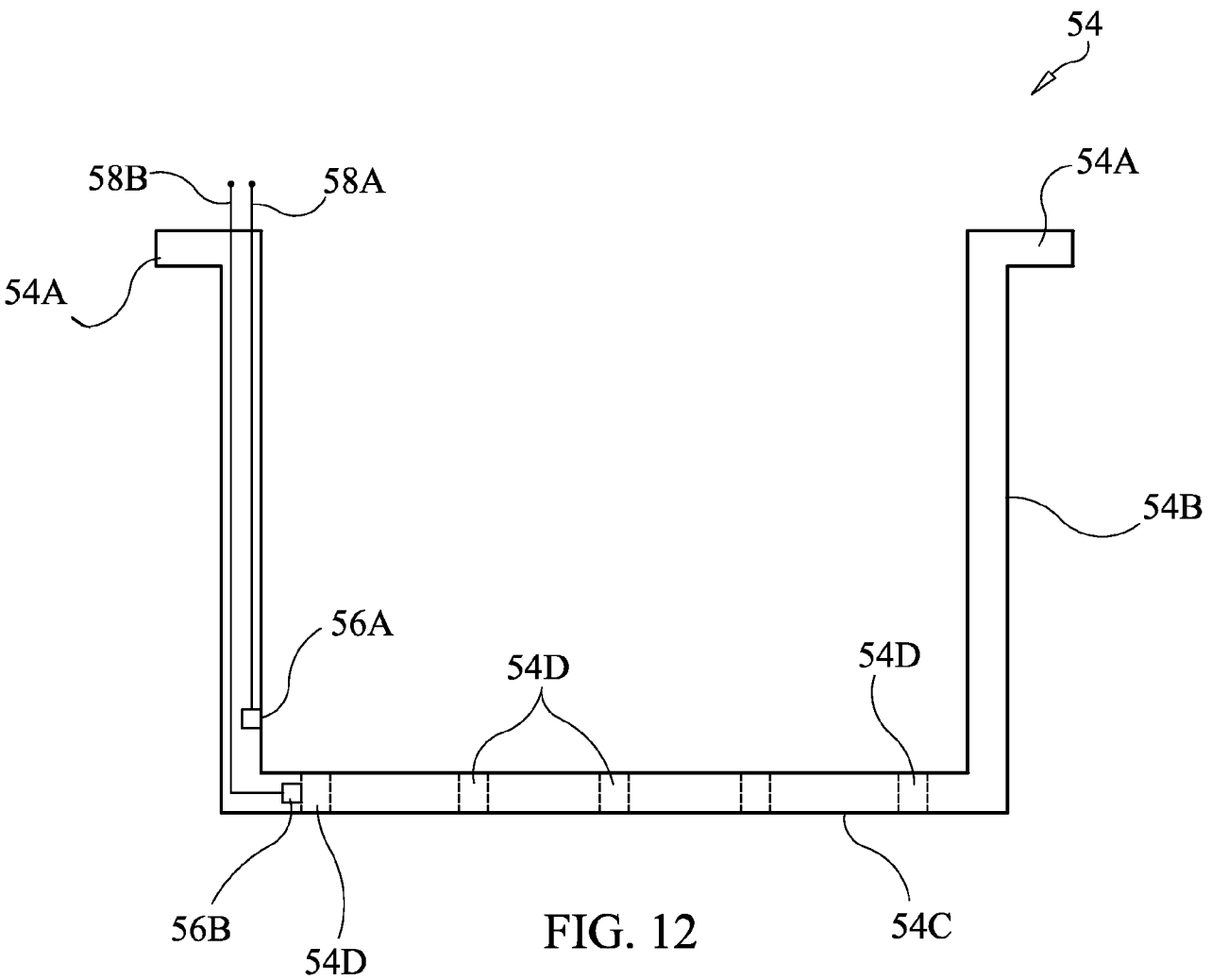
FIG. 12 is an isolated schematic view of a flow sleeve instrumented with pressure sensors in accordance with another embodiment of the present invention.

Although the invention has been described relative to a specific embodiment thereof, there are numerous variations and modifications that will be readily apparent to those skilled in the art in light of the above teachings. For example, FIG. 12 illustrates an isolated view of a flow sleeve further instrumented with pressure sensors. More specifically, flow sleeve 54 has a pressure sensor 56A disposed in sleeve 54 in a region thereof that is between plate 54C and open ends 12B (not shown) of a safety housing that would be installed in sleeve 54. A second pressure sensor 56B is disposed in one of through holes 54D. Pressure sensors 56A and 56B can be used to measure a pressure differential between a fluid flow in sleeve 54 and that passing through plate 54C. In this way, pressure sensors 56A and 56B can be used to develop a pressure differential measurement that indicates (i) an unobstructed flow through sleeve 54 when the pressure differential measurement is at or near zero, or (ii) an obstructed flow through sleeve 54 when the pressure differential measurement is some significant value. Sleeve 54 could also be instrumented with signal leads (e.g., within or along the walls of sleeve 54) 58A and 58B coupled to pressure sensors 56A and 56B, respectively. Leads 58A and 58B could then be coupled to a controller (not shown) designed to automatically turn off a suction pump (coupled to the above-described suction line 200) when the pressure differential measurement was indicative of an obstructed flow. The pressure differential measurement could also be made using submersible wireless transducers. It is therefore to be understood that, within the scope of the appended claims, the invention may be practiced other than as specifically described.

What is claimed as new and desired to be secured by Letters Patent of the United States is:

1. A safety system placed at the inlet of a pool's suction line for controlling water flowing from the pool into the suction line, comprising:

a sleeve adapted to fit within the pool's suction line at the suction line's inlet, said sleeve being open at a first end thereof that is approximately aligned with the suction line's inlet, said sleeve terminating at a second end thereof with a plate adapted to reside within the suction line, said plate having a plurality of holes formed therethrough;

a housing defining a plurality of distinct channels therein, said housing fitted in said sleeve wherein said distinct channels lie within said sleeve, each of said distinct channels having a first opening on one end thereof and a second opening on another end thereof wherein a plurality of first openings and a plurality of second openings are defined, each of said second openings residing in said sleeve, each of said distinct channels being at least approximately three feet in length and traversing a non-linear path; and each of said first openings adapted to be in fluid communication with the water in the pool, said first openings distributed around a periphery of an area of said housing that prevents coverage of all said first openings when a human interacts therewith.

2. A safety system as in claim 1, wherein said housing has a central longitudinal axis, and wherein each of said first openings faces substantially radially outward from said central longitudinal axis.

3. A safety system as in claim 1, wherein said area is defined on top of said housing.

4. A safety system placed at the inlet of a pool's suction line for controlling water flowing from the pool into the suction line, comprising:

a sleeve adapted to fit within the pool's suction line at the suction line's inlet, said sleeve being open at a first end thereof that is approximately aligned with the suction line's inlet, said sleeve terminating at a second end thereof with a plate adapted to reside within the suction line, said plate having a plurality of holes formed therethrough;

an annular flange integrated with said first end of said sleeve and adapted to engage the suction line's inlet when said sleeve is fitted within the suction line;

a housing defining a plurality of distinct channels therein, said housing fitted in said sleeve wherein said distinct channels lie within said sleeve, each of said distinct channels having a first opening on one end thereof and a second opening on another end thereof wherein a plurality of first openings and a plurality of second openings are defined, each of said second openings residing in said sleeve, each of said distinct channels being at least approximately three feet in length and traversing a non-linear path; and each of said first openings adapted to be in fluid communication with the water in the pool, said first openings distributed around a periphery of a top area of said housing that prevents coverage of all said first openings when a human interacts therewith.

5. A safety system as in claim 4, wherein said housing has a central longitudinal axis, and wherein each of said first openings faces substantially radially outward from said central longitudinal axis.

* * * * *